US009295893B2

(12) United States Patent
Bellerive

(10) Patent No.: US 9,295,893 B2
(45) Date of Patent: Mar. 29, 2016

(54) SWIMMING EXERCISING DEVICE

(71) Applicant: Donald Bellerive, Fort Myers, FL (US)

(72) Inventor: Donald Bellerive, Fort Myers, FL (US)

( * ) Notice: Subject to any disclaimer, the term of this patent is extended or adjusted under 35 U.S.C. 154(b) by 39 days.

(21) Appl. No.: 14/171,984

(22) Filed: Feb. 4, 2014

(65) Prior Publication Data

US 2014/0155227 A1 Jun. 5, 2014

Related U.S. Application Data

(63) Continuation-in-part of application No. 12/928,246, filed on Dec. 7, 2010, now Pat. No. 8,641,580, which is a continuation-in-part of application No. 12/460,484, filed on Jul. 20, 2009, now Pat. No. 7,846,072, which is a continuation-in-part of application No. 12/008,314, filed on Jan. 10, 2008, now Pat. No. 7,563,206.

(51) Int. Cl.
*A63B 69/12* (2006.01)
*A63B 69/00* (2006.01)

(52) U.S. Cl.
CPC ..... *A63B 69/12* (2013.01); *A63B 69/0059* (2013.01); *A63B 2208/03* (2013.01)

(58) Field of Classification Search
None
See application file for complete search history.

(56) References Cited

U.S. PATENT DOCUMENTS

| | | | | | |
|---|---|---|---|---|---|
| 2,502,684 | A * | 4/1950 | Ward | 248/515 |
| 2,998,832 | A * | 9/1961 | Lewis | 269/16 |
| 3,207,260 | A * | 9/1965 | Roberts | 182/106 |
| 4,530,497 | A * | 7/1985 | Moran et al. | 482/55 |
| 5,112,023 | A * | 5/1992 | Sowers | 248/519 |
| 5,787,519 | A * | 8/1998 | Smith | 4/496 |
| 5,836,327 | A * | 11/1998 | Davis | 135/16 |
| 7,377,784 | B2 * | 5/2008 | Ryland | 434/254 |
| 7,563,206 | B1 * | 7/2009 | Bellerive | 482/55 |
| 7,707,765 | B2 * | 5/2010 | Liao | 43/21.2 |
| 7,846,072 | B1 * | 12/2010 | Bellerive | 482/55 |
| 7,980,521 | B2 * | 7/2011 | Harr et al. | 248/229.1 |

* cited by examiner

*Primary Examiner* — Stephen Crow
(74) *Attorney, Agent, or Firm* — Larson & Larson, P.A.; Justin P. Miller; Patrick A. Reid

(57) ABSTRACT

Individual swimmers may routinely and easily perform exercise regiments to maintain or enhance their general health and fitness utilizing the present invention. A pole may be secured adjacent a body of water to retain a tether and a harness which retains the swimmer. The pole mount provides for securement at generally any swimming pool utilizing a hand rail which exists with generally all swimming pools. This provides for the swimming exercise device to be extremely transportable while ensuring use without any structural modification to any existing structure of the swimming pool.

19 Claims, 9 Drawing Sheets

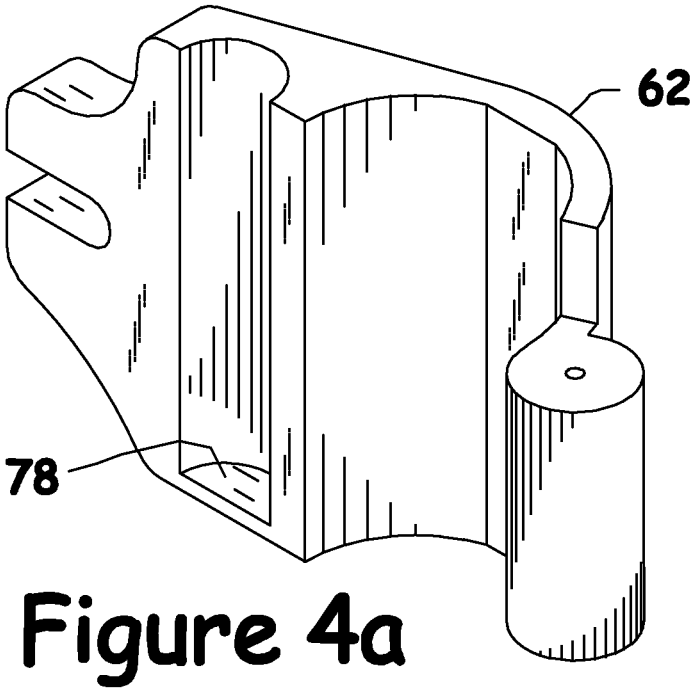
Figure 4a
Figure 4b
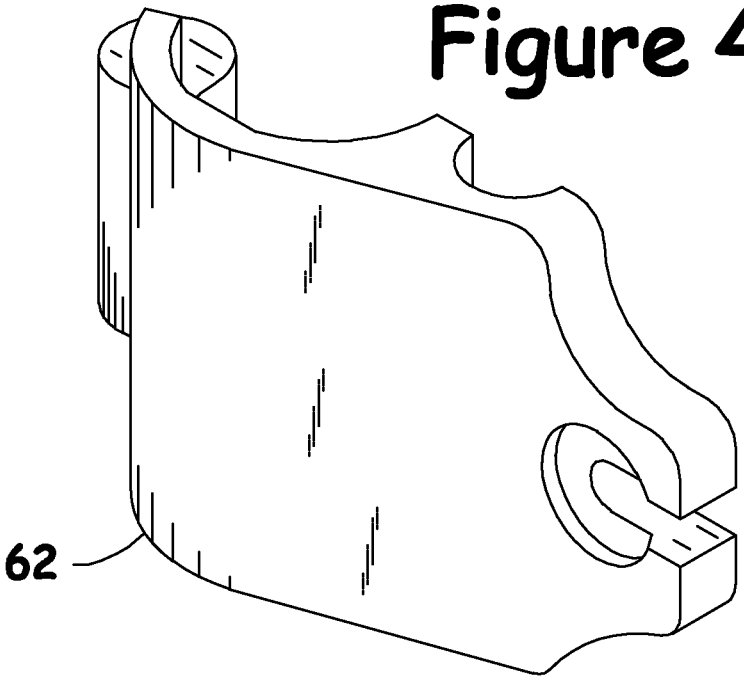

Figure 7
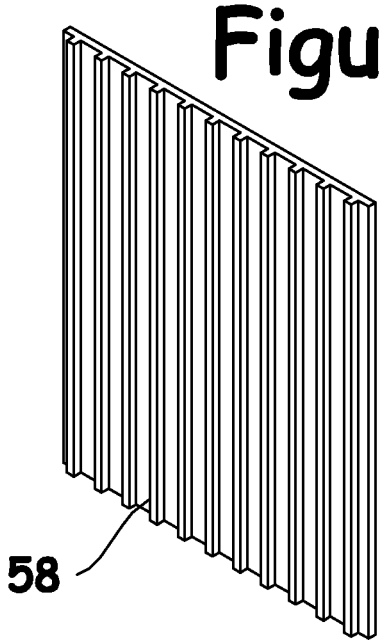
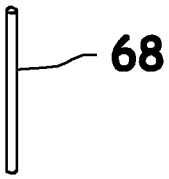
Figure 8
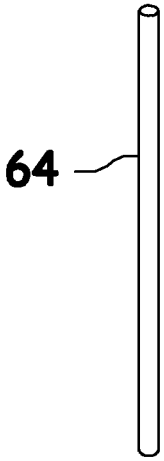
Figure 9

SWIMMING EXERCISING DEVICE

CROSS-REFERENCE

This application is a continuation-in-part of Ser. No. 12/928,246 filed Dec. 7, 2010, currently pending, which was a continuation-in-part of Ser. No. 12/460,484 filed Jul. 20, 2009, now U.S. Pat. No. 7,846,072, which was a continuation-in-part of Ser. No. 12/008,314 filed Jan. 10, 2008, now U.S. Pat. No. 7,563,206. The original applications are incorporated herein by this reference.

BACKGROUND

1. Field of the Invention

Generally, the invention relates to exercise devices which permit a swimmer to be retained in a generally stationary position within a body of water, such as a swimming pool, during performance of a conventional swimming action. More specifically, the invention relates to anchors which are attachable to fixed structures like hand rails associated with pools where the anchor then retains a pole portion of such exercise devices.

2. Description of the Prior Art

Numerous methods exist to exercise portions of the human body. Certain devices have been proposed which provide for the person performing the associated exercise to be in water. It has long been known that swimming is one of the very best forms of exercise. Many types of 'strokes', or swimming styles, are known in conventional swimming. Some of these utilize movement and exertion of the arms more than that of the legs. Some of these utilize movement and exertion of the legs more than that of the arms. Some of these utilize movement and exertion of both the arms and legs. During swimming, even through the arms and legs may appear to be performing most of the action, many muscles of the body are utilized. Therefore, a full body workout can be obtained by swimming for a reasonable period of time.

Swimming is considered by many in the medical and physical fitness fields as a nearly perfect exercise for nearly all persons regardless of age or general physical condition. Unlike running, or even walking, there is no impact delivered to the feet and legs, including all of the joints contained therein, during swimming. Additionally, many styles of swimming simultaneously exercise both the arms and legs during performance of the respective swimming action. Certain land based exercise routines, such as jumping jacks, exercise both the arms and legs simultaneously but typically such exercises due not provide desirable resistance to the limbs during performance of the exercise. Water is the ideal medium for exercise due to the nature of the water and the natural resistance to motion of objects through water. During swimming the swimmer may merely increase their speed of completing each cycle of a stroke to increase the resistance of the exercise. Additionally, during swimming it is easy to change from one selected style of swimming to another style of swimming to vary the workout routine.

The fundamental problem with swimming as an exercise involves the fact that most Americans which routinely swim as an exercise do so in a swimming pool. Therefore, the swimmer will swim from one end of the pool to the opposing end, then turn one hundred and eighty (180) degrees and swim back to the then opposing end. This cycle will then be performed repetitively for the duration of the exercise routine. This constant contact with, or at least approach to, the hard perimeters of the opposing ends of the pool have obvious inherent dangers. Many swimming styles have the swimmer's face down into the water which is raised out of the water to breath and to look forward, if desired. Other swimming styles have the swimmer's face facing upward toward the sky, such as during performance of the backstroke. For these reasons it is difficult for the swimmer to constantly remain aware of their spacial orientation with the perimeter of the pool that they are approaching during movement from one end to the opposing end. Many swimming pools, particularly those associated with a individual home, are relatively small. Additionally, some swimming styles require a depth of water greater than that of the shallow end of some swimming pools. Often the swimmer desiring to perform their exercise routine in a swimming pool will have other swimmers utilizing the swimming pool for their own recreational use. For all of these reasons many persons having access to a swimming pool will not utilize the pool to the fullest extent possible for exercise.

Applicant previously developed and patented, U.S. Pat. No. 4,530,497 issued Jul. 23, 1985, an exercising device which provides many of the benefits of stationary swimming exercise. Applicant has been successfully marketing products based upon applicant's earlier invention for many years. Applicant has recently made numerous improvements to his product line which are the subject matter of the present invention.

Various deficiencies exist with nearly all forms of exercise and devices to facilitate each respective form of exercise. Applicant's previous invention, and products based upon that invention, provide for the optimal exercise routine in an extremely safe manner. Various minor disadvantages exist with applicant's prior invention and products based upon that invention. These minor disadvantages are particularly related to shipping and distribution of such products and transport and storage of such products by the end user and retention of the pole relative to the body of water. As such, it may be appreciated that there continues to be a need for versatile methods of anchoring the pole adjacent the body of water utilizing a hand rail of a swimming pool to be used for exercise. The present invention substantially fulfills these needs.

SUMMARY

In view of the foregoing disadvantages inherent in the known types of exercise devices, your applicant has devised a swimming exercise device for a swimmer to allow generally free movement of legs and arms during performance of a swimming action by the swimmer within a body of water. The performance of the swimming action occurring while the swimmer is being restricted to a generally stationary position in the body of water. The swimming exercise device has a pole, means to retain the pole to an existing hand rail, an engagement member and a connection member. The pole has a securing end, an outer end and a resilient flexibility along a portion of the pole at least near the outer end. The means to retain the pole providing for the securing end of the pole to be retained in a fixed position relative to the body of water utilizing the existing hand rail of the swimming pool. The engagement member contacts the swimmer while leaving the swimmer free to manipulate their legs and arms during performance of the swimming action. The connection member has a first end and a second end. The first end of the connection member is secured relative to the outer end of the pole. The second end of the connection member is secured relative to the engagement member. This combination of the pole, the hand rail mount, the engagement member and the connection member cooperate to provide for a restriction of placement of the swimmer in the body of water during the performance of the swimming action while further providing for a lifting action to the swimmer while in the body of water during the performance of the swimming action. Due to the hand rail mount being easily attachable to, and easily removed from, the existing hand rail of the swimming pool the system is extremely versatile and transportable. Due to the various preferred features of the hand rail mount the existing hand rail of the swimming pool will not be damaged during installation, use or removal.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for an exercise device which will be temporarily attached to an existing hand rail of a swimming pool where the exercise device will retain a swimmer in the swimming pool in a generally stationary placement where the swimmer will exercise utilizing any desired swimming stroke for any desired duration of time.

Other objects include;

a) to provide for a lifting action to be exerted on the generally stationary swimmer where the stationary swimmer has a sensation generally equaling that obtained during movement through the water during conventional swimming.

b) to provide for a flexing of a pole tethering the swimmer where the stationary swimmer does not experience any sudden or unnatural restraining pressure during each stoke of a series of strokes during performance of the swimming action.

c) to provide for a hand rail mount which may be easily and quickly attached and detached from a hand rail of a swimming pool and which does not adversely effect use of the hand rail of the swimming pool when attached thereto.

d) to provide for the hand rail mount to securely retain the pole of the swimming exercise device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 4*a* and FIG. 4*b* are opposing perspective views of another component of the hand rail mount.

FIG. 7 is a perspective view of an additional component of the hand rail mount.

FIG. 8 is a perspective view of an additional component of the hand rail mount.

FIG. 9 is a perspective view of an additional component of the hand rail mount.

DESCRIPTION

Figure 1:
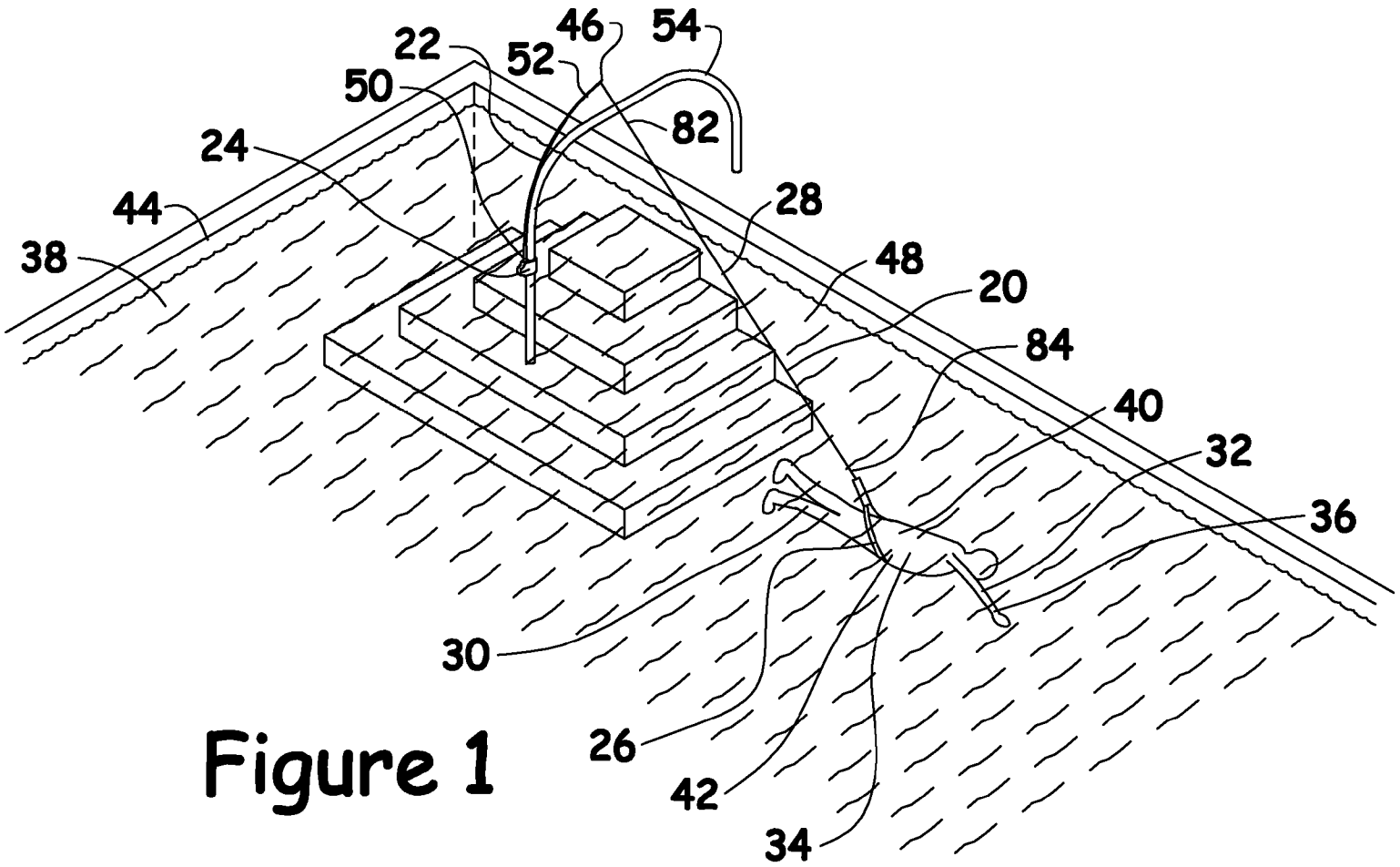
FIG. 1 is a perspective view of a body of water have a swimming exercise device of the present invention positioned thereabout.

Many different systems having features of the present invention are possible. The following description describes the preferred embodiment of select features of those systems and various combinations thereof. These features may be deployed in various combinations to arrive at various desired working configurations of systems.

Reference is hereafter made to the drawings where like reference numerals refer to like parts throughout the various views.

The present invention provides for a person to perform a swimming based exercise in a generally stationary position within a body of water while experiencing all of the benefits of free movement swimming. In order to provide these benefits structural components cooperate to perform various required functions. The required functions include placement restriction, lifting action and resilient motion. Numerous structural arrangements are available to perform each of these functions and may be deployed in various combinations. An anchoring of the pole relative to the body of water, in combination with other structural components, provides for the desired placement restriction of the swimmer within the body of water. The lifting action provides the swimmer with the sensation of free swimming while being retained in a generally fixed location within the body of water. During performance of the swimming action the swimmer will be making the strokes associated with a specific swimming style in a repetitive manner. It being understood that many swimming styles may be utilized with the present invention. During performance of each stroke for any respective swimming style, as is true for conventional free swimming, various degrees of forward force will be applied by the swimmer within the water during a specific point within each of the strokes. During conventional free swimming these variations in propulsion force within each repetitive cycle of strokes would have no noticeable effect upon the swimmer. When the strokes are performed in a tethered manner it is desirable to provide for a certain degree of resilient motion at some location within the tether assembly to maintain a generally uniform pressure between the swimmer and the components of the assembly contacting the swimmer. While this resilient motion may be accommodated within various of the components, or even a combination of components, it has been discovered that the best component to provide this feature is the pole. Additionally, it has been discovered that it is best to restrict this flex of the pole to the uppermost portion of the pole. This is accomplished in the preferred embodiment by providing a taper to the pole, as is conventionally known in fishing poles, where a diminishing of diametric measurement along the length of the pole restricts the flex to the outermost extent of the pole. Of course, if desired, it is possible to provide certain portions of the pole to have a uniform diametric measurement rather than having a taper along the entire length of the pole.

FIG. 1 depicts a swimming exercise device 20 having a pole 22, means to retain pole 22, in the form of a hand rail mount 24, an engagement member 26 and a connection member 28. Swimming exercise device 20 functions to allow a generally free movement of legs 30 and arms 32 of a swimmer 34 during performance of a swimming action 36 by swimmer 34 within a body of water 38 while swimmer 34 is being restricted to a generally stationary position 40 in body of water 38. Pole 22, engagement member 26 and connection member 28 cooperate to provide for restriction of placement of swimmer 34 in body of water 38 during performance of swimming action 36 while further providing for a lifting action 42 to swimmer 34 while in body of water 38 during performance of swimming action 36. The combination of location placement with the lifting action provides for an excellent exercise session which is extremely beneficial to overall health yet is both fun to perform and safe to perform. The present invention provides for swimmer 34 to be retained in stationary position 40 within body of water 38, such as a swimming pool 44, while also providing a certain amount of lift within swimming pool 44 during performance of swimming action 36. To this end of providing for the retention in stationary position 40 pole 22 provides for securement to a fixed position relative to body of water 38. Pole 22 also provides for a certain amount of resilient motion, or flex, which is providing the resistance to swimmer 34 during performance of swimming action 36. To the end of providing the lift during performance of the swimming action it is necessary to provide for elevation of a connection point 46 of pole 22 for connection member 28 above a surface 48 of swimming pool 44.

Also shown in FIG. 1, pole 22 will be provided which will perform several important functions. The pole will provide for an attachment location for the connection member elevated well above the surface of the body of water. This elevated attachment location in combination with an angle of the connection member will provide the desired lifting action to the swimmer during performance of the swimming action. Additionally, a resilient flexibility of the pole will provide for resilient motion of swimmer 34 within swimming pool 44. Pole has a securing end 50, an outer end 52 and a resilient flexibility along a portion of pole 22 at least near outer end 52. Preferably, pole 22 has a gradual and consistent taper from securing end 50 to outer end 52. Pole 22 may be constructed from many suitable materials.

Pole 22 preferably is provided in the form of a multiple part pole having at least two (2) portions which may be easily separated and easily attached. Multiple part poles have the advantage of being easily transported between a storage location and a usage location. While not relevant to the present invention numerous configurations are possible for the actual pole and for the attachment of the parts, if a multiple part pole is utilized. Actual secure locking between adjacent part is possible and preferred, but mere engagement is possible. One example is conventional bayonet penetration without an locking. Additionally, telescoping of portions are possible with or without structures to lock the portions in either extended or withdrawn orientations.

When multiple parts are provided for the pole it is necessary to assemble and secure the various parts. Many coupling and securing methods are known in the art to provide this required function and many of these methods and structures may be utilized with the present invention.

It is possible to provide for at least the pole of the present invention to remain generally permanently positioned relative to the body of water even when not being utilized for performance of the swimming action. More preferably, the pole will be removed when not being utilized for performance of the swimming action. To this end it is desirable that the pole be slidably insertable and removeable relative to hand rail mount. Many variations of hand rail mounts are possible with the most preferred embodiment depicted in the various views.

FIG. 1 depicts hand rail mount 24 which may easily be installed on, and which may easily be removed from, a hand rail 54 associated with swimming pool 44. Hand rail mount 24 completely surrounds hand rail 54 subsequent to installation of hand rail mount 24 and securely is retained at the point of installation for subsequent retention of other components of the present invention.

Applicable hand rail mounts may completely surround, and generally completely radially contact, the existing hand rail of the swimming pool. Alternatively, applicable hand rail mounts may only have intermittent contact points. The desired outcome is to ensure that the hand rail mount remains positioned on the existing hand rail at the desired elevational height. Many structural features many be utilized to achieve this end. The preferred embodiment depicts a classic pivotal hinge between two rigid body members. This arrangement has several advantages including simple to understand installation steps which can be performed by all. It is envisioned to provide for retention of portions with a more flexible coupling between those portions. One example involves utilizing a strip of some planar material as the coupling. This could even form a part of, or even generally all of, the part that contacts the exterior of the existing hand rail of the swimming pool.

The preferred embodiment of securing the hand rail mount involves structures which are securable and which when properly installed require deliberate release. Many structural arrangements are known to radially secure an assembly around a tubular member and these can be used with the present invention. The most basic of these involve opposing engagable portions with displacement to tighten and secure. These sort of structures are often utilized to secure cylinders, such as fire extinguishers, into housing mounts. While these sort of arrangement may easily and readily be employed for the present invention they have the disadvantage of being inadvertently and unintentionally released.

The term means to secure refers to structures which cooperate to secure the hand rail mount relative to the existing hand rail associated with the body of water wherein the hand rail mount is prohibited from migrating elevationally along the existing hand rail associated with the body of water.

The term means to retain refers to structures which retain the securing end of the pole relative to a hand rail associated with the body of water.

The term means to apply a contracting pressure refers to structures which apply an inwardly directed pressure to an exterior of the existing hand rail wherein the hand rail mount is generally prohibited from migrating elevationally along the existing hand rail associated with the body of water.

Figure 3A:
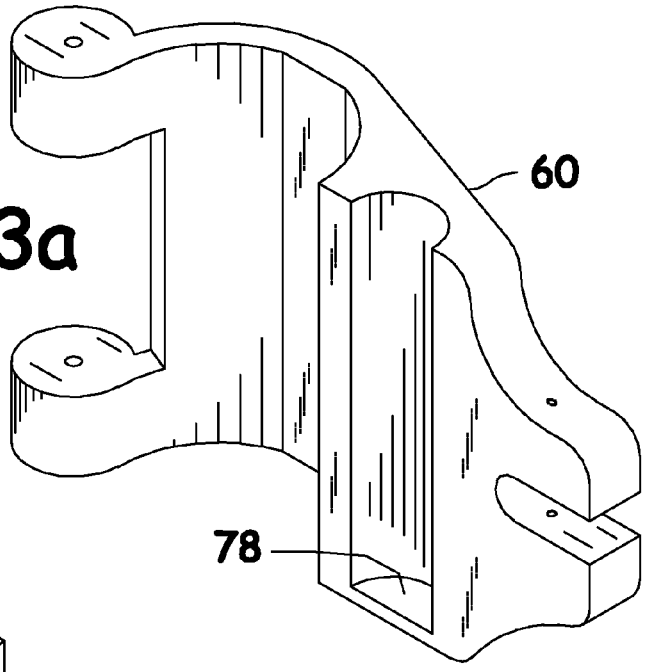
FIG. 3*a* and FIG. 3*b* are opposing perspective views of a component of a hand rail mount.
Figure 3B:
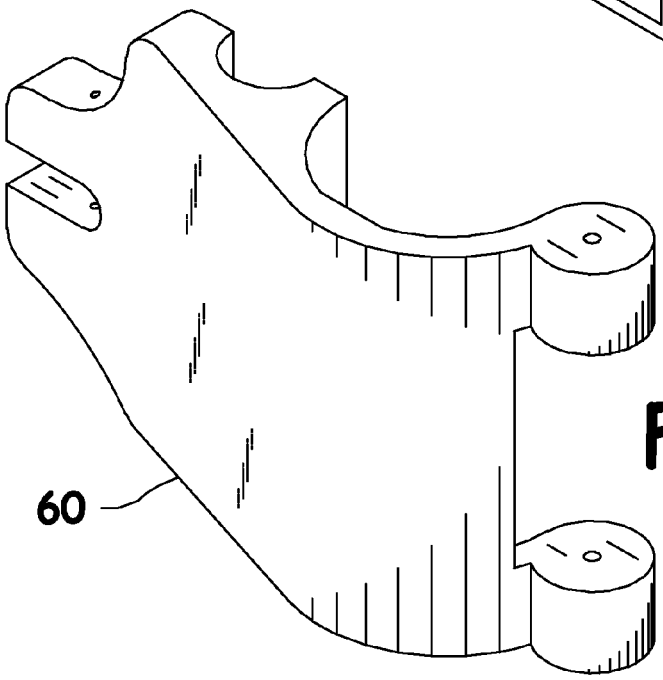
Figure 5A:
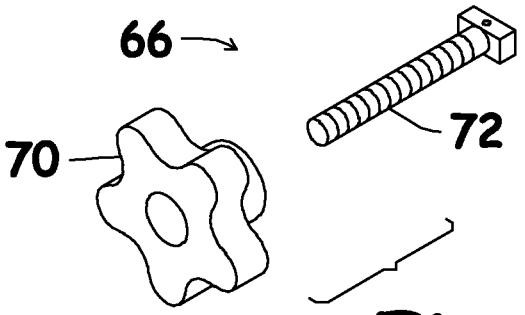
FIG. 5*a* and FIG. 5*b* are opposing perspective views of additional components of the hand rail mount and depicted in a detached arrangement.
Figure 5B:
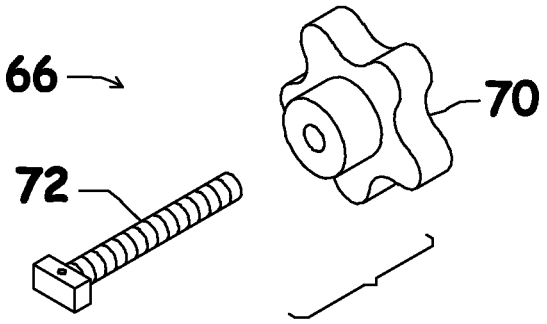
Figure 6:
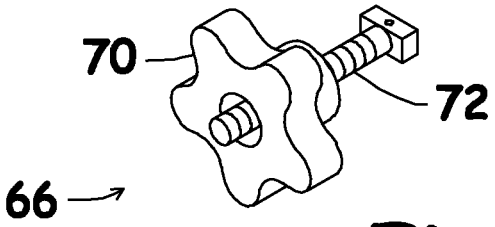
FIG. 6 is a perspective view of the components depicted in FIG. 5*a* and FIG. 5*b* in an assembled arrangement.
Figure 10A:
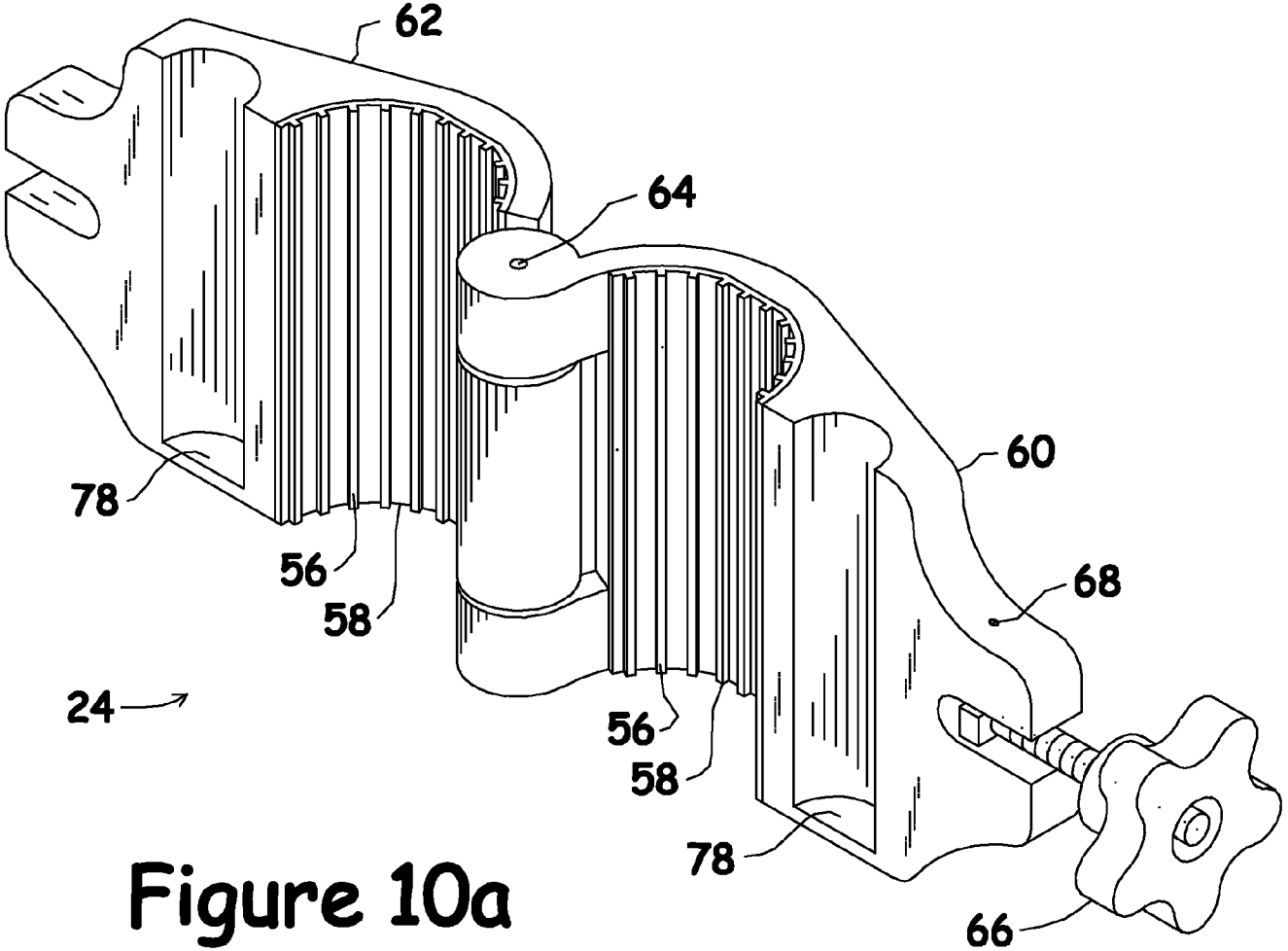
FIG. 10*a* through FIG. 10*d* are perspective views of the hand rail mount subsequent to assembly and depicted in various operational orientations.
Figure 10B:
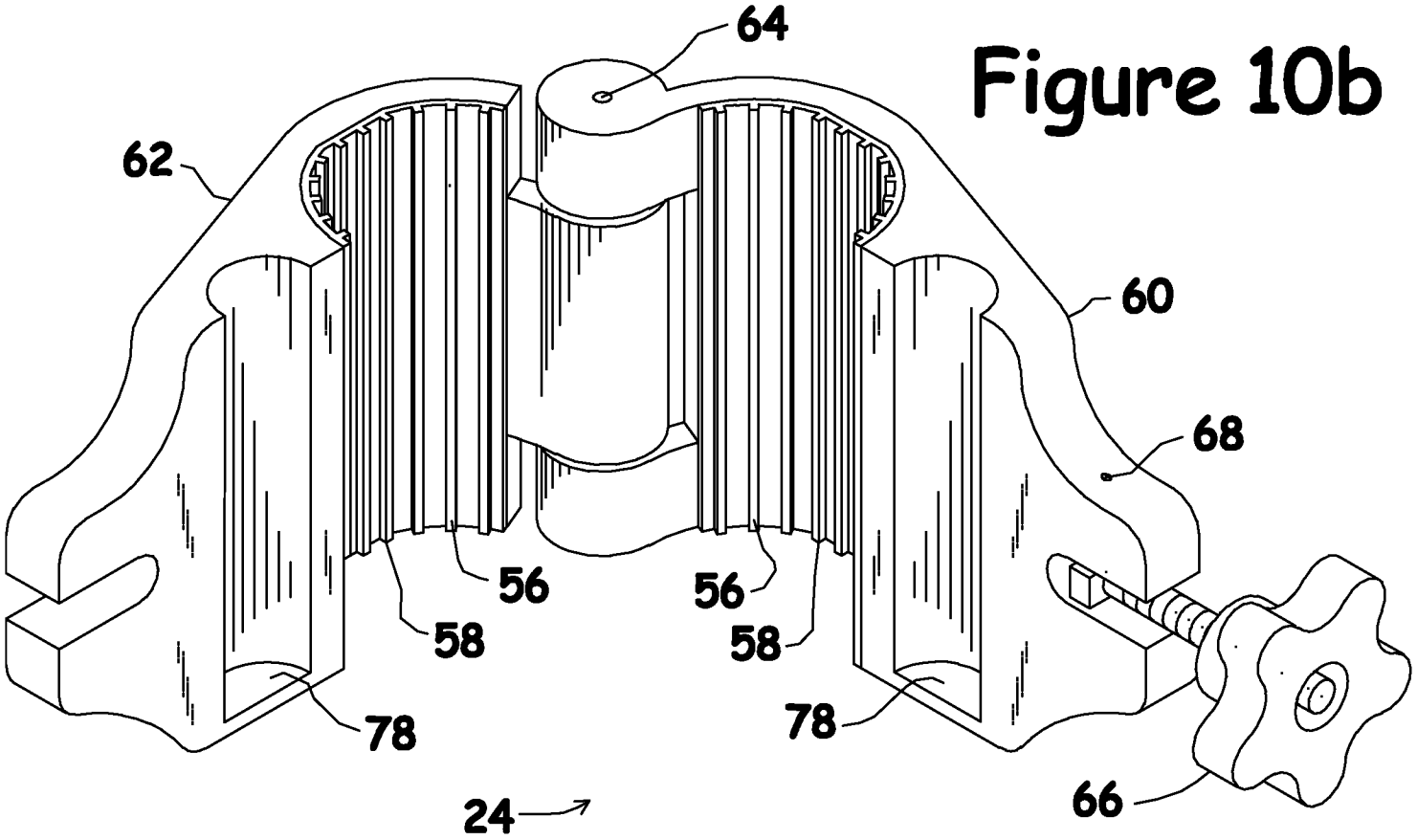
Figure 10C:
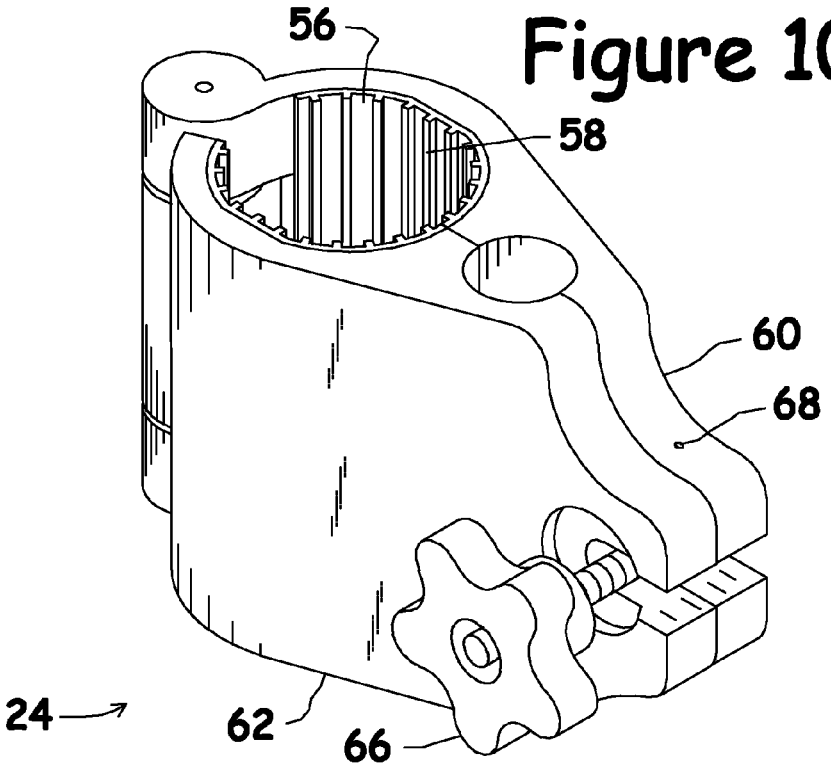
Figure 10D:
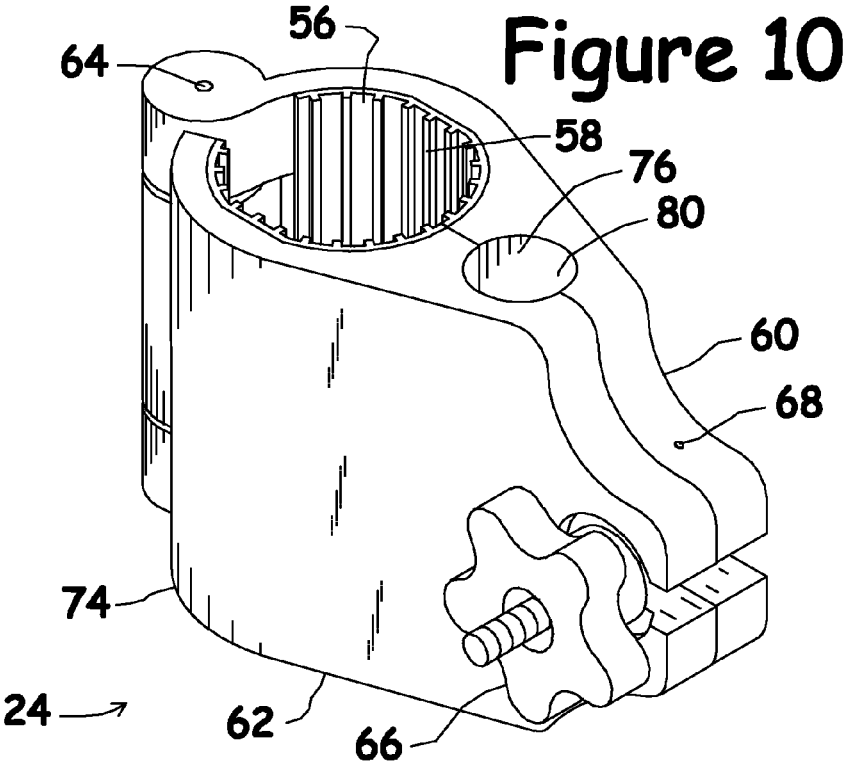

Referring now to FIG. 1 and FIG. 3*a* through FIG. 10*d*, hand rail mount 24 has a hand rail contact surface 56 which makes contact with hand rail 54 subsequent to installation. Hand rail contact surface 56 of hand rail mount 24 is formed of opposing pieces of a compressible resilient material 58, see FIG. 7. Hand rail mount 24 has a first body member 60, a second body member 62 and a hinge member 64. First body member 60 is shown in FIGS. 3*a* and 3*b* while second body member 62 is shown in FIGS. 4*a* and 4*b*. Hinge member 64 is depicted in FIG. 9. First body member 60 and second body member 62 are attached to hinge member 64. This provides for first body member 60 and second body member 62 to pivot relative to each other at hinge member 64 to provide for placement over hand rail 54 during installation of hand rail mount 24 and to provide for removal from hand rail 54. A pivotal threaded anchor 66 is pivotally attached to first body member 60 utilizing a securing pin 68, depicted in FIG. 8. Pivotal threaded anchor 66 has a threaded coupling member 70 and a threaded portion 72, see FIGS. 5*a* and 5*b* and FIG. 6. Threaded coupling member 70 is selectively displaceable along threaded portion 72 to provide for pressure bearing contact of pivotal threaded anchor 66 with second body member 62 utilizing manipulation of threaded coupling member 70 for movement along threaded portion 72 of pivotal threaded anchor 66. This pressure bearing contact, see FIG. 10*d*, provides for first body member 60 and second body member 62 to be retained in contact with any desired locational position on hand rail 54.

Hand rail mount 24 has an installed orientation 74, see FIG. 10*d*, where a pole penetration recess 76 is positioned thereon while hand rail mount 24 is in installed orientation 74. Pole penetration recess 76 has a generally closed bottom 78 while hand rail mount 24 is in installed orientation 74. Pole penetration recess 76 slidably receives securing end 50 of pole 22 during performance of the swimming action. Pole penetration recess 76 has an outer perimeter 80 along a depth while in installed orientation 74 with outer perimeter 80 of pole penetration recess 76 generally symmetrically disposed on first body member 60 and second body member 62.

Figure 2:
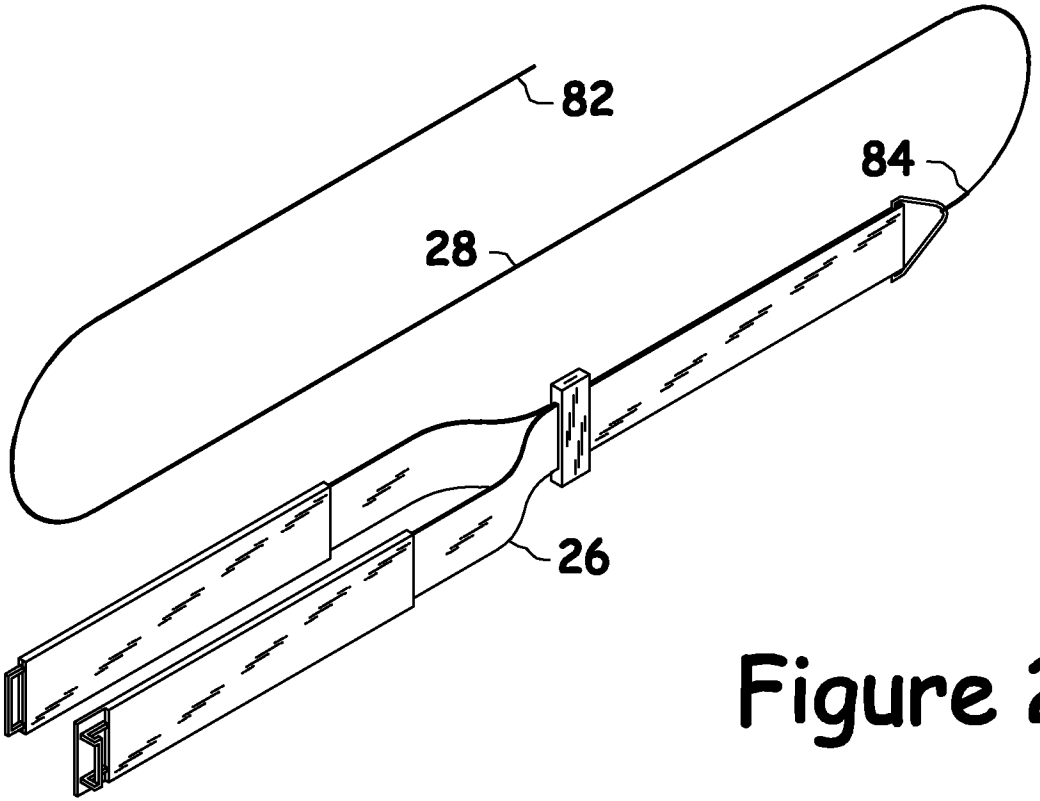
FIG. 2 is a perspective view of an engagement member and a connection member of the swimming exercise device.

An engagement member will be provided to contact the swimmer while leaving the swimmer free to manipulate their legs and arms during performance of the swimming action. This may involve mere surrounding contact of the torso of the swimmer, as depicted in FIG. 1 by engagement member 26 depicted in FIG. 2, or may involve a more elaborate harness type system. In the preferred embodiment depicted engagement member 26 is of a sufficient width and is padded for comfort during performance of the swimming action.

A connection member will be provided to connect the engagement member contacting and retaining the swimmer to the pole. Various structural components may be utilized to perform this function. FIG. 1 depict connection member 28 having a first end 82 and a second end 84 with first end 82 secured relative to outer end 52 of pole 22 and second end 84 secured relative to engagement member 26. It is possible to provide for the connection member to be of a construction to have an elastic property to provide the resilient motion function of the present invention. In the preferred embodiment depicted connection member 28 is merely a conventional nylon strand braided cord.

The following disclosure is not specific to the method utilized to secure the swimming exercise device relative to the body of water. It being understood that the following features, in any desired combination, can be utilized without regard for the anchoring system to retain the swimmer in the desired generally stationary position during performance of the swimming action. A system will keep track of numerous information and store that information for subsequent use during an exercise session utilizing equipment having features of applicant's various inventions. It is also possible to provide the user with immediate feedback on details measured during an exercise session. Such immediate feedback can take numerous methods to convey information to the swimmer including audio and visual indicators. In order to perform these features it is necessary to place a measuring component somewhere were stress will be applied to the component in response to the swimmer's exercise activity. Ideally this will occur at, or near, the outer end of the pole where the connection member attaches. This placement provides for the measuring component to be at a point where pressure routinely occurs during the exercise session and which is at the highest elevation above the body of water. When audio feedback to the user is provided it is possible to place a waterproof, or resistance, component on the user such as ear buds where the user will receive the audio information and modify his exercise experience immediately based on that information.

Numerous types of information will be available during each exercise session. Examples include number of strokes, pulling force exerted during each stroke, duration of time for each stroke, the various levels of force applied within each stroke and many other examples. Additionally, other information will preferably be gathered at least at the start of an exercise session and at the end of the exercise session. Examples include heart rate, such as number of beats per minute, and respiration rate, such as number of cycles of inhaling and exhaling per minute. Blood pressure is information which can be extremely valuable, especially when analyzed historically.

When physiological information is gathered the components that take those measurements can be worn by the swimmer, or otherwise attached to the swimmer. Alternatively, the components can be placed near the location where the exercise session is occurring and the swimmer may interact with those components on some predetermined frequency.

It is known for swimmers to have an exercise session with a series of exertion sessions where the swimmer actively swims in a generally stationary position with intervening rest periods. Preferably components will take these measurements as compared to the swimmer manually timing such rates and manually recording such rates. This is to eliminate the tendency for people to occasionally forget to perform certain desired steps. When a measurement component is utilized which is not worn by the swimmer during the exercise session it is desirable to have some audio reminder arrangement available.

It is possible to determine average force exerted, minimum force exerted, maximum force exerted, average force exerted for beginning predetermined number of strokes and average force exerted for ending predetermined number of strokes. Of course a predetermined number of strokes at the beginning of the session and at the end of the session could be ignored from the calculations if desired.

Computations can be performed, in real time during an exercise session or historically, to determine how a specific swimmer is performing. Such information is invaluable to the swimmer to inform them if they are obtaining their specific goals. Typically someone starting to use the SuperSwim products will wish to see steady improvement in their performance as they grow stronger and more physically fit. Typically someone who has been using the products for a long time will have reached their ideal fitness level and wish to maintain that peak condition.

When real time feedback is provided it can act to remind the swimmer to complete a desired exercise level for that specific session. Examples include that a predetermined number of stroke cycles have been performed or that a certain predetermined level of force is being reached or that a predetermined length of time has been utilized for the session.

It is possible to analyze a swimmers performance for specific types of swimming strokes and make comparisons to the performance of other swimmers or to some predefined ideal stroke. Feedback from this type of analysis can inform a swimmer if they are exerting excessive force at certain points in the stroke cycle or exerting insufficient force at certain points in the stroke cycle. Additionally, such analysis can inform the swimmer as to what portion of a stroke cycle suffers at certain points within a predefined exercise session.

Numerous methods are known in the art to input data into electronic components and generally any known method can be utilized with the session monitoring components. Preferably the swimmer will be able to inform the component of what type of swimming stroke is being utilized. Similarly numerous methods are known in the art to transfer data from one electronic component to another and generally any known method can be utilized for data transfer between components. Wireless transmission of data when components are positioned near the body of water or when the user is wet from swimming is preferred.

Components can provide the swimmer with real time feedback on their activity level compared to a predefined desired or target activity level. One example involves an audio signal which sounds a first warning if the swimmer is exerting too little force during a specific portion of a session and which sounds a second warning, unique from the first warning, if the swimmer is exerting too much force during a specific portion of a session. These unique audio warnings provide for the swimmer to make adjustments to their exertion levels without interrupting or otherwise interfering with the session. Similar audio signals can be utilized to inform the swimmer to switch from one swimming style to another swimming style within an exercise session at the conclusion of some predefined event. Such signaling may involve elapse of a period of time, completion of a set number of stroke cycles, upon reaching a target force exertion level or upon reaching a physiological level, such as reaching a target heart rate.

Many types of sensors are known in the art. It is possible to utilize multiple sensors, or a sensor package which makes multiple measurements. While pulling force is one of the most important standards being examined, many other conditions can be utilized individually or in some desired combination. Examples include sensors which can determine acceleration and deceleration. Due to the arcing effect of poles having features of the present invention it is possible to measure angular orientation to a known orientation, such as true horizontal or true vertical. From this measurement it can then be determined how much movement is occurring to the anchor point of the connection member to the pole. This can then be converted into movement of the swimmer within the body of water during each swimming stroke cycle.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A swimming exercise device for a swimmer to allow generally free movement of legs and arms during performance of a swimming action by the swimmer within a body of water while the swimmer is being restricted to a generally stationary position in the body of water, the body of water having an existing hand rail, the swimming exercise device comprising:

a) a pole having a securing end, an outer end;

b) a hand rail mount having an installed orientation when positioned on the existing hand rail, the hand rail mount having:

i) means to secure the hand rail mount relative to the existing hand rail associated with the body of water wherein the hand rail mount is prohibited from migrating along the existing hand rail associated with the body of water;

ii) means to retain the securing end of the pole relative to a hand rail associated with the body of water;

c) an engagement member to contact the swimmer while leaving the swimmer free to manipulate their legs and arms during performance of the swimming action;

d) a connection member having a first end and a second end with the first end secured relative to the outer end of the pole and the second end secured relative to the engagement member;

wherein the hand rail mount, the pole, the engagement member and the connection member cooperate to provide for a restriction of placement of the swimmer in the body of water during the performance of the swimming action while further providing for a lifting action to the swimmer while in the body of water during the performance of the swimming action;

wherein the hand rail amount has a hand rail contact surface which makes contact with the hand rail associated with the body of water subsequent to an installation of the hand rail mount and wherein the hand rail contact surface of the hand rail mount further comprises a compressible resilient material.

2. The swimming exercise device defined in claim 1 wherein the hand rail mount surrounds the hand rail associated with the body of water subsequent to an installation of the hand rail mount.

3. The swimming exercise device defined in claim 1 wherein the hand rail mount has a first body member and a second body member which are movably attached to one another and wherein each of the first body member and the second body member radially surround a portion of the existing hand rail.

4. The swimming exercise device defined in claim 1 wherein the hand rail mount further comprises a hinge member, a first body member attached to the hinge member and a second body member attached to the hinge member wherein the first body member and the second body member pivot relative to each other at the hinge member to provide for placement over the hand rail associated with the body of water during an installation of the hand rail mount.

5. The swimming exercise device defined in claim 1 wherein the hand rail mount has at least two body members which are movably attached to one another and wherein each of the body members radially surround a portion of the existing hand rail and wherein the means to secure the hand rail mount relative to the existing hand rail associated with the body of water further comprises an anchor which acts on at least two of the body members and which has a released orientation and a secured orientation.

6. The swimming exercise device defined in claim 5 wherein the anchor further comprises a pivotal threaded anchor and threaded coupling member, the pivotal threaded anchor pivotally attached to a first of the body members and securable relative to a second of the body members utilizing manipulation of the threaded coupling member for movement along a threaded portion of the pivotal threaded anchor.

7. The swimming exercise device defined in claim 5 wherein means to retain the securing end of the pole relative to a hand rail associated with the body of water further comprises a pole penetration recess formed on at least one of the body members, wherein the pole penetration recess slidably receives the securing end of the pole.

8. The swimming exercise device defined in claim 1 wherein the pole further has a resilient flexibility along a portion of the pole at least near the outer end.

9. The swimming exercise device defined in claim 1 wherein the means to retain the securing end of the pole relative to a hand rail associated with the body of water further comprises a pole penetration recess and wherein the pole penetration recess has a generally closed bottom while the hand rail mount is in the installed orientation.

10. The swimming exercise device defined in claim 9 wherein the hand rail mount has at least two body members which are movably attached to one another and wherein the pole penetration recess has an outer perimeter along a depth while in the installed orientation and wherein the outer perimeter of the pole penetration recess is generally symmetrically disposed on two of the body members.

11. The swimming exercise device defined in claim 1 wherein the hand rail mount is secured to a generally vertical portion of the existing hand rail associated with the body of water.

12. A swimming exercise device for a swimmer to allow generally free movement of legs and arms during performance of a swimming action by the swimmer within a body of water while the swimmer is being restricted to a generally stationary position in the body of water, the body of water having an existing hand rail, the swimming exercise device comprising:

a) a pole having a securing end, an outer end;

b) a hand rail mount having an installed orientation when positioned on the existing hand rail, the hand rail mount having:

i) means to apply a contracting pressure to an exterior of the existing hand rail wherein the hand rail mount is prohibited from migrating along the existing hand rail associated with the body of water;

ii) means to retain the securing end of the pole relative to a hand rail associated with the body of water;

c) an engagement member to contact the swimmer while leaving the swimmer free to manipulate their legs and arms during performance of the swimming action;

d) a connection member having a first end and a second end with the first end secured relative to the outer end of the pole and the second end secured relative to the engagement member;

wherein the hand rail mount, the pole, the engagement member and the connection member cooperate to provide for a restriction of placement of the swimmer in the body of water during the performance of the swimming action while further providing for a lifting action to the swimmer while in the body of water during the performance of the swimming action;

wherein the hand rail mount has a hand rail contact surface which makes contact with the hand rail associated wit the body of water subsequent to an installation of the hand rail mount and wherein the hand rail contact surface of the hand rail mount further comprises a compressible resilient material.

13. The swimming exercise device defined in claim 12 wherein the hand rail mount surrounds the hand rail associated with the body of water subsequent to an installation of the hand rail mount.

14. The swimming exercise device defined in claim 12 wherein the hand rail mount has a first body member and a second body member which are movably attached to one another and wherein each of the first body member and the second body member radially surround a portion of the existing hand rail.

15. The swimming exercise device defined in claim 12 wherein the means to apply a contracting pressure to an exterior of the existing hand rail further provides for the hand rail mount to be prohibited from migrating axially around the existing hand rail associated with the body of water.

16. A swimming exercise device for a swimmer to allow generally free movement of legs and arms during performance of a swimming action by the swimmer within a body of water while the swimmer is being restricted to a generally stationary position in the body of water, the body of water having an existing hand rail, the swimming exercise device comprising:

a. a pole having a securing end, an outer end;

b. a hand rail mount having an installed orientation when positioned on the existing hand rail, the hand rail mount having:

i. means to secure the hand rail mount relative to the existing hand rail associated with the body of water wherein the hand rail mount is generally prohibited from migrating along the existing hand rail associated with the body of water;

ii. means to retain the securing end of the pole relative to a hand rail associated with the body of water;

c. an engagement member to contact the swimmer while leaving the swimmer free to manipulate their legs and arms during performance of the swimming action;

d. a connection member having a first end and a second end with the first end secure relative to the outer end of the pole and the second end secured relative to the engagement member;

wherein the hand rail mount, the pole, the engagement member and the connection member cooperate to provide for a restriction of placement of the swimmer in the body of water during the performance of the swimming action while further providing for a lifting action to the swimmer while in the body of water during the performance of the swimming action;

wherein the hand rail mount has a first body member and a second body member which are movably attached to one another and wherein each of the first body member and the second body member radially surround a portion of the existing hand rail;

wherein the pole further has a resilient flexibility along a portion of the pole at least near the outer end.

17. The swimming exercise device defined in claim 16 wherein the hand rail mount generally completely surrounds the hand rail associated with the body of water subsequent to an installation of the hand rail mount.

18. The swimming exercise device defined in claim 16 wherein the hand rail mount has a hand rail contact surface which makes contact with the hand rail associated with the body of water subsequent to an installation of the hand rail mount and wherein the hand rail contact surface of the hand rail mount further comprises a compressible resilient material.

19. The swimming exercise device defined in claim 16 wherein the means to retain the securing end of the pole relative to a hand rail associated with the body of water further comprises a pole penetration recess and wherein the pole penetration recess has a generally closed bottom while the hand rail mount is in the installed orientation.

* * * * *